United States Patent [19]

Beesch

[11] 3,949,723

[45] Apr. 13, 1976

[54] AIR PRE-HEATING ARRANGEMENT FOR COMBUSTION ENGINES

[75] Inventor: Otto Beesch, Stuttgart, Germany

[73] Assignee: Robert Bosch GmbH, Stuttgart, Germany

[22] Filed: Dec. 10, 1973

[21] Appl. No.: 423,519

Related U.S. Application Data

[63] Continuation of Ser. No. 161,233, July 9, 1971, abandoned.

[30] Foreign Application Priority Data

Sept. 28, 1970 Germany ..... 2047589

[52] U.S. Cl. ..... 123/179 H; 123/122 G

[51] Int. Cl.[2] ..... F02N 17/00; F02M 39/00

[58] Field of Search ..... 123/122 G, 179 L, 179 G

[56] References Cited

UNITED STATES PATENTS

| | | | |
|---|---|---|---|
| 1,235,255 | 7/1917 | Stewart | 123/122 |
| 1,424,394 | 8/1922 | Doolittle | 123/122 |
| 1,602,790 | 10/1926 | Tibbetts | 123/122 |
| 1,617,605 | 2/1927 | Peterson | 123/122 |
| 3,656,465 | 4/1972 | Frankle | 123/122 |

FOREIGN PATENTS OR APPLICATIONS

| | | | |
|---|---|---|---|
| 361,726 | 8/1938 | Italy | |
| 120,375 | 8/1919 | United Kingdom | 123/122 |
| 488,368 | 9/1949 | Canada | 123/122 |

*Primary Examiner*—Wendell E. Burns
*Assistant Examiner*—Ronald B. Cox
*Attorney, Agent, or Firm*—Michael J. Striker

[57] ABSTRACT

An intake conduit or manifold for air for combustion engines has an auxiliary burning chamber provided in one of its walls which communicates with the interior of the intake conduit. A valve can establish or terminate communication between the chamber and the conduit in a sense permitting some of the air from the latter to flow into the former. An injector injects vaporized fuel into the burning chamber and a spark plug ignites the fuel so that the heat of combustion is transmitted to air flowing through the intake manifold to thereby preheat such air.

11 Claims, 2 Drawing Figures

INVENTOR

OTTO BEESCH

BY M. S. STRIKER

ATTORNEY

AIR PRE-HEATING ARRANGEMENT FOR COMBUSTION ENGINES

CROSS-REFERENCE TO RELATED APPLICATIONS

This is a continuation application of application Serial No. 161,233 filed 7/9/71, now abandoned, and entitled "Air Pre-Heating Arrangement for Combustion Engines".

BACKGROUND OF THE INVENTION

The present invention relates generally to combustion engines, and more particularly to an arrangement for pre-heating air which is supplied to a combustion engine, particularly to a Diesel engine.

It is well known that Diesel engines do not inherently start up as readily as gasoline engines. They are therefore usually provided with a cold-starting arrangement which makes it possible to start the Diesel engine even in cold condition readily, that is in the same expeditous manner in which a gasoline engine can be started under similar circumstances. These arrangements usually should also be of the type which permits post or after-combustion during low-load operating periods in order to obtain low-smoke, low-ignition exhaust vapors without the formation of fog and after-burning effects. Various arrangements have become known for this purpose, but it is equally known that none of them has been entirely satisfactory.

SUMMARY OF THE INVENTION

It is, accordingly, an object of the present invention to provide an arrangement of the type under discussion which avoids the disadvantages of the prior art and affords the desirable advantages outlined above.

More particularly, it is an object of the present invention to provide such an arrangement which is simple in its construction and operation.

A concomitant object of the invention is to provide such an arrangement which is reliable in its operation.

In pursuance of the above objects and others which will become apparent hereafter, one feature of my invention resides in an arrangement of the type under discussion which, briefly stated, comprises wall means defining a flow path for air and a burning chamber proximal to but separate from the flow path in heat-exchanging relationship therewith. A valve is provided for connecting the chamber with the flow path, injecting means is provided for injecting vaporized fuel into the burning chamber, and igniting means is provided for igniting the injected vaporized fuel in the chamber for combustion therein so as to exchange heat with air which is flowing in the flow path.

The operation of the fuel injecting and combusting means can be controlled in dependence upon a selected operational parameter of the combustion engine itself, for instance in dependence upon the number of revolutions per time unit, the under-pressure or negative pressure in the main flow path, or the temperature of the cooling water for the engine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
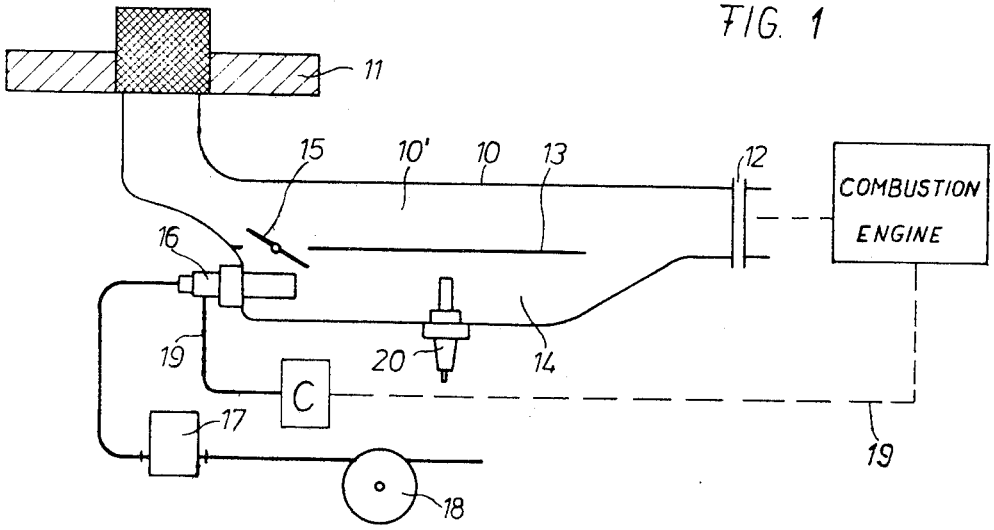
FIG. 1 is a diagrammatic illustration showing one exemplary embodiment of the invention.

Before discussing the drawing in detail it is pointed out that all such components which are not considered necessary for an understanding of the present invention, have been omitted for the sake of clarity. Thus, it will be seen that the combustion engine, here assumed to be a Diesel engine, which receives air through the manifold in which the arrangement according to the present invention is installed, has been shown only in form of a box, Diesel engines or combustion engines in general being well enough known not to require a detailed discussion. Evidently, such a Diesel engine may be cooled by circulating cooling water, and suitable means —also well known in the art-- may be provided for monitoring the number of revolutions per unit of time which are being performed by this engine.

Keeping this in mind it will be seen that in FIG. 1 reference numeral 10 diagrammatically illustrates an intake manifold constituting a flow path for air which is aspirated by a Diesel engine. The air flows through the manifold 10 to the Diesel engine which, as pointed out before, has been illustrated in form of a box to show it diagrammatically. At its upstream end the manifold 10 is provided with a conventional air filter 11 and at its downstream end 12 the air is supplied from the manifold 10 to the cylinders of the combustion engine, in pre-heated condition in accordance with the present invention.

Reference numeral 13 designates a divider wall which subdivides the manifold into two parallel channels, namely the main channel 10' through which the incoming combustion air flows, and a burning chamber 14 which is located adjacent to and communicates with the main channel 10'. A flap-type valve 15 is installed in the divider wall 13 and can close automatically, that is it is movable between a closed position and a fully opened position. The valve 15 is located at one end of the burning chamber whose other end is open to the channel 10'.

A vaporizing nozzle 16 is installed so as to communicate with the interior of the burning chamber 14, into which it injects fuel in vaporized state adjacent the valve 15 as shown in the drawing. The nozzle 16, which is of conventional construction, receives fuel from a non-illustrated fuel container via a similarly non-illustrated fuel filter, a magnet valve 17 and a pump 18. The quantity of fuel ejected by the nozzle 16 is controlled by the diagrammatically illustrated control device C which is connected with the nozzle 16 and with the combustion engine via conductor means 19. Located in the combustion engine may for instance be a device for counting the number of revolutions per time unit or a sensor for sensing the temperature of the cooling water, and in either case such a device would yield a signal to the control device C which in turn controls the operation of the nozzle 16 to govern the quantity of fuel which is atomized and injected by the same. There is further provided a spark plug 20 which in conventional manner is connected with a source of electrical energy and which is partially located in the burning chamber 14 so as to effect combustion of the atomized injected fuel which mixes in the chamber 14 with air entering the latter via the valve 15 from the main channel 10'.

When atomized fuel is ignited and combusted in the burning chamber 14, heat exchange takes place with the incoming combustion air which passes along the flow path in the channel 10' into the combustion engine. Thus, this incoming air is pre-heated.

The operation of the novel arrangement according to the present invention may be manually controlled, or it may be automatically controlled. In the latter case, the movement of the valve 15 between closed and opened positions can be controlled in dependence upon the operational parameters of the engine which have been selected for this purpose, for instance in dependence upon the number of revolutions of the engine, in dependence upon the cooling water temperature, in dependence upon the negative pressure existing in the conduit 10', in dependence upon the temperature of the combustion gases in the manifold, or in dependence upon another desired parameter. The arrangement can also be constructed in such a manner that as the valve 15 moves from closed to its open position the pump 18, the magnet valve 17, the nozzle 16 and the spark plug 20 are simultaneously energized. The device C may be a pump of the type disclosed in U.S. Pat. Nos. 2,826,179 or 2,737,121, which cooperates with the nozzle 16 --which latter may be constructed according to the disclosures of U.S. Pat. Nos. 2,751,253, 2,786,719 or 2,825,393-- to effect complete and constant atomization of the fuel.

Control of the operation of the nozzle 16 can be effected electronically and the atomized fuel can be injected in a constant way or in a pulsating way to the burning chamber 14. In this case, the device C will be a signal or impulse generator which controls the constant or pulsating supply of fuel to the nozzle 16 and from there into the burning chamber 14. The device C may then be constructed in accordance with the teachings of U.S. Pat. Nos. 3,338,221, 3,425,401, 3,429,302, 3,430,616 or 3,448,728. Sensors are then installed at suitable points of the engine, for instance in the cooling water circuit, in the outlet manifold, or wherever the parameter in dependence upon which the arrangement is to operate has to be measured. Such sensors --which may also be of wellknown construction-- will be energized when the engine is started and will provide a signal after measuring the existing operational parameter such as the temperature of the combustion air, and of the cooling water, thereby initiating operation of combustion in the burning chamber 14. It is also possible to make the fuel-air ratio dependent upon the number of revolutions of the engine, the requisite heat energy required and the ratio which is needed to maintain proper combustion in the chamber 14.

Figure 2:
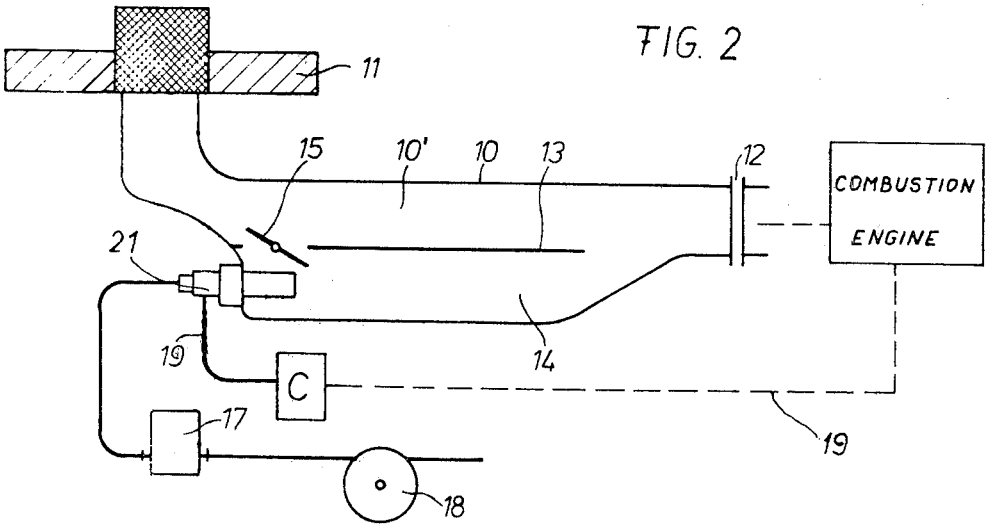
FIG. 2 is a view similar to FIG. 1 but showing a somewhat modified embodiment of the invention.

For simplicity of installation the injecting nozzle 16 and the spark plug 20 can also be combined with one another, so as to constitute a single unit. This is shown in the embodiment of FIG. 2 wherein, all other components being the same as in FIG. 1, the unit composed of the combined nozzle and spark plug is identified with reference numeral 21. A detailed description of the unit 21 is not thought to be necessary, because such a unit is already disclosed in U.S. Pat. Nos. 3,316,397, 3,434,461 and 3,502,055.

It will be understood that each of the elements described above, or two or more together may also find a useful application in other types of constructions differing from the types described above.

While the invention has been illustrated and described as embodied in an air pre-heating arrangement of combustion engines, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. Arrangement for supplying pre-heated intake air to a Diesel engine comprising, in combination, an elongated manifold having an upstream portion communicating with the ambient atmosphere, a longitudinally spaced downstream portion communicating with the Diesel engine, and an elongated enlarged portion intermediate said upstream and downstream portions of said manifold, said enlarged portion defining an elongated enclosed compartment having an inlet portion communicating with said upstream portion, and a longitudinally spaced outlet portion communicating with said downstream portion of said manifold; an elongated partition arranged in said elongated compartment extending longitudinally thereof and of said manifold and partitioning said elongated compartment in said enlarged portion into two parallel elongated passages, one of which is an elongated airflow passage and the other of which is an elongated combustion passage, said elongated partition extending from said inlet portion and terminating short of said outlet portion so as to subdivide said inlet portion into an inlet of said elongated airflow passage and an inlet of said elongated combustion passage, and so as to form one outlet from said elongated airflow passage and anotuer outlet from said elongated combustion passage into said outlet portion of said elongated compartment, said elongated partition being formed with an inlet port communicating said upstream portion of said manifold with said inlet of said elongated combustion passage, said inlet into and outlet from said elongated airflow passage being permanently open so as to permit continuous passage of air through said elongated airflow passage and into said downstream portion of said manifold leading to the Diesel engine during operation thereof, and said outlet from said elongated combustion passage being also permanently open; valve means mounted in said partition in the region of said inlet port leading into said elongated combustion passage, and operative for controlling the flow-through cross-section of said inlet port to thereby adjustably branch off a portion of the air stream passing through said upstream portion of said manifold and admit the same into said elongated combustion passage; means for injecting a spray of fuel under positive pressure into said elongated combustion passage in the region of said inlet thereof so that said fuel spray becomes admixed with said branched-off portion of said air stream and forms therewith a combustible mixture in said elongated combustion passage downstream of said inlet; and ignition means in said combustion passage for igniting said combustible mixture so as to generate heat which heats said partition whereby the latter exchanges heat with and preheats the air flowing through said elongated airflow passage, the hot combustion products from said elongated combustion passage joining and becoming admixed with the air flowing through said elongated airflow passage in said outlet portion of said elongated compartment whereby said air stream is additionally pre-heated during its passage through said downstream portion of said manifold.

2. A combination as defined in claim 1; and further comprising feeding means for feeding fuel to said injecting means in pressurized condition.

3. A combination as defined in claim 1; and further comprising control means operatively associated with said Diesel engine and said injecting means for controlling the operation of the latter in dependence upon predetermined operational parameters of the former.

4. A combination as defined in claim 2, said valve means comprising a valve flap turnable between a fully blocking and a fully unblocking position; and wherein said valve flap is operatively connected with said injecting means and igniting means for initiating the operation of the same in response to said valve flap turning from said fully blocking position toward said fully unblocking position.

5. A combination as defined in claim 3, wherein said feeding means comprises a fuel pump for supplying fuel to said injecting means, and a magnet valve interposed between said fuel pump and said injecting means and both being operatively associated with said valve flap for operation in response to turning of the latter between said positions.

6. A combination as defined in claim 1, wherein said engine is water-cooled and has a cooling-water circulation; and wherein said injecting means is controlled in dependence upon the temperature of said cooling water.

7. A combination as defined in claim 4, wherein said control means comprises a tachometer for determining the number of revolutions of said engine per unit time; and wherein said injecting means is controlled in dependence upon said number of revolutions.

8. A combination as defined in claim 4, wherein said injecting means is controlled in dependence upon subatmospheric pressure in said intake manifold.

9. A combination as defined in claim 1, wherein said injecting means comprises an injecting nozzle for injecting said fuel into said combustion passage in a constant spray.

10. A combination as defined in claim 1, wherein said injecting means comprising an injecting nozzle for injecting said fuel into said combustion passage in a pulsating spray.

11. A combination as defined in claim 1, wherein said igniting means comprises a spark plug mounted in said combustion passage and a source of high voltage connected with said spark plug.

* * * * *